US007232777B1

(12) United States Patent
Van Hyning

(10) Patent No.: US 7,232,777 B1
(45) **Date of Patent: *Jun. 19, 2007**

(54) YARNS AND FABRICS HAVING A WASH-DURABLE ANTIMICROBIAL SILVER PARTICULATE FINISH

(76) Inventor: Dirk L. Van Hyning, 106 Beechwood Dr., Spartanburg, SC (US) 29307

( * ) Notice: Subject to any disclaimer, the term of this patent is extended or adjusted under 35 U.S.C. 154(b) by 0 days.

This patent is subject to a terminal disclaimer.

(21) Appl. No.: 09/585,762

(22) Filed: Jun. 2, 2000

(51) Int. Cl.
*B32B 5/02* (2006.01)
*B32B 27/04* (2006.01)
*C11D 3/00* (2006.01)

(52) U.S. Cl. ..... 442/123; 428/340; 428/341; 428/342; 252/8.82; 8/115.51

(58) Field of Classification Search ..... 442/173, 442/6, 7, 169, 279, 237, 181, 228, 229, 304, 442/316, 327, 376, 377, 379, 123; 428/340, 428/341, 342; 8/115.1; 252/8.82
See application file for complete search history.

(56) References Cited

U.S. PATENT DOCUMENTS

| | | | | | |
|---|---|---|---|---|---|
| 5,265,770 | A | | 11/1993 | Matkovich et al. | 222/189 |
| 5,432,000 | A | * | 7/1995 | Young, Sr. et al. | 428/372 |
| 5,849,311 | A | * | 12/1998 | Sawan et al. | 424/406 |
| 5,981,063 | A | * | 11/1999 | Yokozeki et al. | 428/365 |
| 6,149,927 | A | * | 11/2000 | Ghosh | 424/405 |
| 6,584,668 | B2 | * | 7/2003 | Green et al. | 29/527.2 |
| 6,821,936 | B2 | * | 11/2004 | Green et al. | 510/319 |
| 6,946,433 | B2 | * | 9/2005 | Green et al. | 510/319 |
| 2002/0127402 | A1 | * | 9/2002 | Green et al. | 428/377 |
| 2002/0192386 | A1 | * | 12/2002 | Green et al. | 427/402 |
| 2003/0026914 | A1 | * | 2/2003 | Green et al. | 427/407.1 |
| 2003/0200613 | A1 | * | 10/2003 | Green et al. | 8/115.51 |
| 2003/0204916 | A1 | * | 11/2003 | Green et al. | 8/115.51 |
| 2004/0009344 | A1 | * | 1/2004 | Krienke et al. | 428/328 |
| 2005/0229328 | A1 | * | 10/2005 | Tran | 8/115.51 |
| 2006/0000025 | A1 | * | 1/2006 | Dixon et al. | 8/115.51 |
| 2006/0198209 | A1 | * | 9/2006 | Tran | 365/189.05 |

FOREIGN PATENT DOCUMENTS

| | | | |
|---|---|---|---|
| GB | 2 185 998 | * | 8/1997 |
| JP | H11-124729 | | 5/1999 |

* cited by examiner

*Primary Examiner*—N. Bhat
(74) *Attorney, Agent, or Firm*—Terry Moyer; Brenda D. Wentz

(57) ABSTRACT

Durable silver particulate treatments for yarns and textile fabrics are provided. Such treatments provide, as one example, an antimicrobial fiber and/or textile fabric which remains on the surface and retains its antimicrobial characteristics after a substantial number of standard launderings and dryings. The method of adherence to the target yarn and/or fabric may be performed any number of ways, most preferably through the utilization of a binder system. The particular method of adherence, as well as the treated textile fabrics and individual fibers are also encompassed within this invention.

15 Claims, No Drawings

YARNS AND FABRICS HAVING A WASH-DURABLE ANTIMICROBIAL SILVER PARTICULATE FINISH

FIELD OF THE INVENTION

This invention relates to improvements in durable silver particulate treatments for yarns and textile fabrics. Such treatments provide, as one example, an antimicrobial fiber and/or textile fabric which remains on the surface and retains its antimicrobial characteristics after a substantial number of standard launderings and dryings. The method of adherence to the target yarn and/or fabric may be performed any number of ways, most preferably through the utilization of a binder system. The particular method of adherence, as well as the treated textile fabrics and individual fibers are also encompassed within this invention.

DISCUSSION OF THE PRIOR ART

There has been a great deal of attention in recent years given to the hazards of bacterial contamination from potential everyday exposure. Noteworthy examples of such concern include the fatal consequences of food poisoning due to certain strains of *Eschericia coli* being found within undercooked beef in fast food restaurants; *Salmonella* contamination causing sicknesses from undercooked and unwashed poultry food products; and illnesses and skin infections attributed to *Staphylococcus aureus, Klebsiella pneumoniae*, yeast, and other unicellular organisms. With such an increased consumer interest in this area, manufacturers have begun introducing antimicrobial agents within various household products and articles. For instance, certain brands of polypropylene cutting boards, liquid soaps, etc., all contain antimicrobial compounds. The most popular antimicrobial for such articles is triclosan. Although the incorporation of such a compound within liquid or polymeric media has been relatively simple, other substrates including the surfaces of textiles and fibers, have proven less accessible. There is a long-felt need to provide effective, durable, and long-lasting antimicrobial characteristics for textile surfaces, in particular on apparel fabrics, and on film surfaces. Such proposed applications have been extremely difficult to accomplish with triclosan, particularly when wash durability is a necessity (triclosan easily washes off any such surfaces). Furthermore, although triclosan has proven effective as an antimicrobial compound, the presence of chlorines and chlorides within such a compound causes skin irritation which makes the utilization of such with fibers, films, and textile fabrics for apparel uses highly undesirable. Furthermore, there are commercially available textile products comprising acrylic and/or acetate fibers co-extruded with triclosan (for example Celanese markets such acetate fabrics under the name Microsafe™ and Acordis markets such acrylic fibers under the tradename Amicor™). However, such an application is limited to those types of fibers; it does not work specifically for and within polyester, polyamide, cotton, spandex, etc., fabrics. Furthermore, this co-extrusion procedure is very expensive.

Silver-containing inorganic microbiocides have recently been developed and utilized as antimicrobial agents on and within a plethora of different substrates and surfaces. In particular, such microbiocides have been adapted for incorporation within melt spun synthetic fibers, as taught within Japanese unexamined Patent Application No. H11-124729, in order to provide certain fabrics which selectively and inherently exhibit antimicrobial characteristics. Furthermore, attempts have been made to apply such specific microbiocides on the surfaces of fabrics and yarns with little success from at both durability and antimicrobial effectiveness (i.e., kill rate above 99%/log kill rate over 2.0). A topical treatment with such compounds has never been successfully applied as a durable finish or coating on a fabric or yarn substrate. Although such silver-based agents provide excellent, durable, antimicrobial properties, to date such is the sole manner available within the prior art of providing a long-lasting, wash-resistant, silver-based antimicrobial textile. However, such melt spun fibers are expensive to make due to the large amount of silver-based compound required to provide sufficient antimicrobial activity in relation to the migratory characteristics of such a compound within the fiber itself to its surface. A topical coating is also desirable for textile and film applications, particularly after finishing of the target fabric or film. Such a topical procedure permits treatment of a fabric's individual fibers prior to weaving, knitting, and the like, in order to provide greater versatility to the target yarn without altering its physical characteristics. Such a coating, however, must prove to be wash durable, particularly for apparel fabrics, in order to be functionally acceptable. Furthermore, it is highly desirable for such a metallized treatment to be electrically non-conductive on the target fabric, yarn, and/or film surface. Such a non-conductive property reduces potential conductivity problems and also requires a relatively low amount of metal is present on the surface (in order to effectively prevention percolation over the fabric or fiber surface). With the presence of metals and metal ions, such a wash durable, antimicrobial, yet non-electrically conductive treatment has not been available in the past. Such an improvement would thus provide an important advancement within the textile, yarn, and film art. Although antimicrobial activity is one desired characteristic of the inventive metal-treated fabric, yarn, or film, this is not a required property of the inventive article. Odor-reduction, heat retention, distinct colorations, reduced discolorations, improved yarn and/or fabric strength, resistance to sharp edges, etc., are all either individual or aggregate properties which may be accorded the user of such an inventive treated yarn, fabric, or film.

DESCRIPTION OF THE INVENTION

It is thus an object of the invention to provide a simple manner of effectively treating a yarn, textile, or film with a wash-durable antimicrobial metal or metal-ion containing treatment. A further object of the invention is to provide a treatment for textiles or films which is wash-durable and continuously reduces and/or kills microbes from the treated surface through the utilization of silver particles. Another object of the invention is to provide an aesthetically pleasing metal- or metal-ion-treated textile or film which is wash durable, non-irritating to skin, and which provides antimicrobial properties, with no deleterious effect on the hand, drape, etc., of the treated fabric.

Accordingly, this invention encompasses a treated substrate comprising a finish comprising solid compounds selected from the group consisting of metal particles, metal salts, metal oxides, and any combinations thereof, and a substrate selected from the group consisting of a yarn, a fabric comprised of individual fibers, and a film; wherein said finish is adhered to at least one portion of the surface of said substrate; wherein said finish is integrally retained on said at least one portion of the surface of said substrate, after 10 washes as performed in accordance with the wash procedure of AATCC Test Method 130-1981, in an amount of at least 30% of the amount of said finish present on said at least one portion of the surface of said substrate prior to the performance of any wash procedure. Also contemplated within this invention is a treated substrate comprising a substrate selected from the group consisting of a yarn and a fabric comprised of individual yarns, a treatment comprising solid compounds selected from the group consisting of metal particles, metal salts, metal oxides, and any mixtures thereof, and at least one nonionic binder material; wherein said particles are adhered to at least a portion of the surface of said substrate; and wherein said treated substrate exhibits a log kill rate for *Staphylococcus aureus* of at least 1.5, preferably at least 2.0, and more preferably at least 3.0 and a log kill rate for *Klebsiella pneumoniae* of at least 1.5, preferably at least 2.0, and more preferably at least 3.0, both as measured in accordance with AATCC Test Method 100-1993 for 24 hour exposure, after at least 10 washes, said washes being performed in accordance with the wash procedure as part of AATCC Test Method 130-1981. Even more preferable, these log kill rates are at least 3.2 and 3.2, respectively for *S. aureus* and *K. pneumoniae*, more preferably at least 3.5 and 3.5, respectively. Such an invention also encompasses the different methods of producing such a treated substrate. The wash durability test noted above is standard and, as will be well appreciated by one of ordinary skill in this art, is not intended to be a required or limitation within this invention. Such a test method merely provides a standard which, upon 10 washes in accordance with such, the inventive treated substrate will not lose an appreciable amount of its electrically non-conductive metal treating. Preferably, such wash durability will be above 15 washes, more preferably above 20, and most preferably above 30, all in accordance with the AATCC Test Method noted above.

The term "integrally retained" used above and within the claims merely requires that the metal finish be clearly discernable and measurable [such as by inductively coupled plasma (ICP) or atomic absorption (AA) spectroscopy], both in amount and in structure. In such a fashion, the retained metal finish can properly function as intended (i.e., as an antimicrobial, an odor reduction material, etc.). Thus, as it compares with the initial amount applied to the target substrate surface, at least 30% must be integrally retained after the 10 wash standard. Preferably, this amount exceeds the 30%, as high as 50%, 65%, 85%, 95%, most preferably. Furthermore, this minimum retention amount (30%) is preferably met after 20 washes, and as high as 30 washes (and more as well).

Surprisingly, this topical application (with binders) does not exhibit any undesirable effects on the hand or drape of the target fabric itself. Although the metal finish is primarily a solid, geometric particle, such a finish is substantially unnoticeable by touch; only instrumental analysis can detect the actual particles which provide the desirable characteristics noted above.

Furthermore, the inventive substrates necessarily do not exhibit any appreciable electrical conductivity (due to the low amounts of metal present and thus the nonexistence of any percolation over or through the target substrate) as measured by attaching a two-inch by two-inch fabric specimen to two electrodes and applying a voltage gradient of about 100 volts per inch through the fabric (i.e., in accordance with AATCC Test Method 76-1978). The measured resistance in ohms per square inch should exceed about 10,000 in order to provide a substantially non-electrically conductive fabric.

Nowhere within the prior art has such a specific treated substrate or method of making thereof been disclosed, utilized, or fairly suggested. The closest art is a product marketed under the tradename X-STATIC® which is a fabric article electrolessly plated with a silver coating. Such a fabric is highly electrically conductive and is utilized for static charge dissipation. Also, the coating alternatively exists as a removable silver powder finish on a variety of surfaces. The aforementioned Japanese patent publication to Kuraray is limited to fibers within which a silver-based compound has been incorporated through melt spun fiber techniques. Nowhere has such a wash-durable topical treatment as now claimed been mentioned or alluded to.

Any yarn or fabric may be utilized as the substrate within this application. Thus, natural (cotton, wool, and the like) or synthetic fibers (polyesters, polyamides, polyolefins, and the like) may constitute the target substrate, either by itself or in any combinations or mixtures of synthetics, naturals, or blends or both types. As for the synthetic types, for instance, and without intending any limitations therein, polyolefins, such as polyethylene, polypropylene, and polybutylene, halogenated polymers, such as polyvinyl chloride, polyesters, such as polyethylene terephthalate, polyester/polyethers, polyamides, such as nylon 6 and nylon 6,6, polyurethanes, as well as homopolymers, copolymers, or terpolymers in any combination of such monomers, and the like, may be utilized within this invention. Nylon 6, Nylon 6,6, polypropylene, and polyethylene terephthalate (a polyester) are particularly preferred. Additionally, the target fabric may be coated with any number of different films, including those listed in greater detail below. Furthermore, the substrate may be dyed or colored to provide other aesthetic features for the end user with any type of colorant, such as, for example, poly(oxyalkylenated) colorants, as well as pigments, dyes, tints, and the like. Other additives may also be present on and/or within the target fabric or yarn, including antistatic agents, brightening compounds, nucleating agents, antioxidants, UV stabilizers, fillers, permanent press finishes, softeners, lubricants, curing accelerators, and the like. Particularly desired as optional and supplemental finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture. The preferred soil release agents contemplated within this invention may be found in U.S. Pat. Nos. 3,377,249; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference. Additionally, other potential additives and/or finishes may include water repellent fluorocarbons and their derivatives, silicones, waxes, and other similar water-proofing materials.

The particular treatment must comprise at least one type of metal particle-generating compounds (such as silver particle-generating compounds), or mixtures of different types thereof. The term metal is intended to include any such historically understood member of the periodic chart (including transition metals, such as, without limitation, silver, zinc, copper, nickel, iron, magnesium, manganese, vanadium, gold, cobalt, platinum, and the like, as well as other types including, without limitation, aluminum, tin, calcium, magnesium, antimony, bismuth, and the like). More preferably, the metals utilized within this invention are generally those known as the transition metals. Of the transition metals, the more preferred metals are silver, zinc, gold, copper, nickel, manganese, and iron. Most preferred are silver and zinc. Such metals provide the best overall desired characteristics, such as, preferably, antimicrobial and/or odor reducing characteristics, certain colorations, good lightfastness, and, most importantly, wash durability on the target substrate.

The term metal particle is intended to encompass any compound which comprises at least one metal in its elemental or ionic state (thus $Ag^0$ or $Ag^+$ may be present, as one example). Metal salts may also be present in some amount either in a pure state, or reduced to produce the desired metal particles. Such salts thus comprise metal cationic components with suitable anionic components. The term metal oxide encompasses, as should be clear from the description, any oxide of a metal (thus silver oxide may be present, again as one example). Metal particles may be produced through a reduction procedure and may preferably be any of silver, nickel, copper, zinc, and iron. In the presence of a reducing agent, the salts utilized for this purpose are thus preferably silver (I) nitrate, nickel (II) perchlorate, copper (II) acetate, zinc chloride, and iron (II) sulfate. Also available as a potentially preferred metal particle-generating compound is an antimicrobial silver zirconium phosphate available from Milliken & Company, under the tradename ALPHASAN®, although any silver-containing antimicrobial compound, including, for instance, and as merely some examples, a silver-substituted zeolite available from Sinanen under the tradename ZEOMIC® AJ, or a silver-substituted glass available from Ishizuka Glass under the tradename IONPURE®, may be utilized either in addition to or as a substitute for the potentially preferred species. Also preferred as such a compound is zinc oxide, zinc ricinoleate, zinc chloride, and zinc sulfate. Other metals, as noted above, may also be utilized; however, from a performance standpoint, silver and zinc, are most preferred. Generally, such a metal particle or metal oxide compound is added in an amount of from about 0.001 to 10% by total weight of the particular treatment composition; more preferably from about 0.05 to about 2.0%; and most preferably from about 0.1 to about 1.0%. The metal compound is then added to the target substrate in amounts of between 0.0002 and 0.02 ounces per square yard for the best antimicrobial and/or odor-reducing performance in relation to both wash durability and electrical non-conductivity. Preferably this metal compound add-on weight is about 0.002 ounces per square yard. The treatment itself, including any necessary binders, adherents, thickeners, and the like, is added to the substrate in an amount of about 0.01 to about 4.0 ounces per square yard.

The selected substrate may be any of an individual yarn, a fabric comprising individual fibers or yarns (though not necessarily previously coated yarns), or a film (either standing alone or as laminated to a fabric, as examples). The individual fibers or yarns may be of any typical source for utilization within fabrics, including natural fibers (cotton, wool, ramie, hemp, linen, and the like), synthetic fibers (polyolefins, polyesters, polyamides, polyaramids, acetates, rayon, acylics, and the like), and inorganic fibers (fiberglass, boron fibers, and the like). The target yarn may be of any denier, may be of multi- or mono-filament, may be false-twisted or twisted, or may incorporate multiple denier fibers or filaments into one single yarn through twisting, melting, and the like. The target fabrics may be produced of the same types of yarns discussed above, including any blends thereof. Such fabrics may be of any standard construction, including knit, woven, or non-woven forms. The films may be produced from any thermoplastic or thermoset polymer, including, but not limited to, polyolefins (polypropylene, polyethylene, polybutylene), polyvinyl chloride, polyvinylidene chloride, polyvinyl acetate, and the like, polyesters (polyethylene terephthalate, isophthalates, and the like) polyethers, acetates, acrylics, and polyamides, as well as any copolymer films of any of the above. Such films may be extruded, blown, rolled, and the like, and may be produced in situ on the surface of a target fabric or produced separately and subsequently adhered or laminated on a target surface. Also, such films may be produced, treated, and utilized separately from any other substrates.

The yarns are preferably incorporated within specific fabrics, although any other well known utilization of such yarns may be undertaken with the inventive articles (such as tufting for carpets). The inventive fabrics may also be utilized in any suitable application, including, without limitation, apparel, upholstery, bedding, wiping cloths, towels, gloves, rugs, floor mats, drapery, napery, bar runners, textile bags, awnings, vehicle covers, boat covers, tents, and the like. The inventive films may be present on fabrics, or utilized for packaging, as coatings for other types of substrates, and the like.

Yarn substrates are preferably treated with a metal particle finish. Fabric substrates may also be treated with such a finish, or with a metal-ion containing formulation. Films are preferably treated with metal-ion containing formulations as well.

The preferred metal particle composition will generally comprise four components: water, a metal salt, a reducing agent, and a polymeric binder. As noted above, the metal is produced through the reduction of the metal ion upon dissolution of the metal salt in solution. This specific process actually blends two different technologies, specifically the formation of colloidal particles by chemical reduction and steric stabilization of such particles by surfactant or polymer and the modification of a fiber (or textile) surface through the utilization of a polymeric binder. In this instance, the steric stabilizer and the fiber (or textile) binder are the same polymeric compound.

Such a metal particle dispersion is generally produced as follows: A solution of the polymeric binder and water is produced having a polymer concentration between 0.1% and 20% (w/w). The solution is then divided between two containers, one containing a dissolved metal salt (i.e. a metal salt MA dissociates completely to $M^+$ and $A^-$) and in the other, a dissolved reducing agent. When combined, the reducing agent transfers electrons to the metal cations and/or ionic clusters and reduces them to their neutral form ($M_n^+ + e^- \rightarrow M_n^0$). The metal clusters quickly agglomerate to form larger (1–1000 nm) particles. The steric stabilizer acts by adsorbing to the surface of the growing particles and thereby prevents catastrophic flocculation of the particles into macroscopic (~mm in diameter) aggregates by limiting the distance of closest approach of the particles.

It is important to note that the selection of the particular polymeric binder is crucial to the success in attaining the desired durability and effectiveness of the specific coating as this binder component must meet a number of important criteria. First, since high salt concentrations are necessary to generate large numbers of metal particles, and such salts generally cause many polymeric binder dispersions to flocculate out of solution, the particular binder must not react in such a manner in order to effectively stabilize the particles that are produced (as noted above). Secondly, the binder must not act like typical textile binders (which do not stabilize the particles and thus allow the nucleated particles to flocculate rapidly into macroscopic assemblies) which would render the resultant solution unusable in this application. Thirdly, it is important that the polymeric stabilizer, once processed, be able to withstand home washing under a wide range of conditions and maintain the silver concentration on the textile. Thus, it must not be readily soluble in water, must not be susceptible to attack by standard and/or industrial detergents, solvents, and/or bleaches, and must not melt upon exposure to drying temperatures. The utilization of such a specific binder to provide a metal coating to fibers and/or fabrics is thus drastically different from other previous practices in this area and permits a topical application of a such a coating either before or after the particular substrate has been finished. In order to provide the requisite wash durability, this binder must pass these stringent criteria. No teaching or fair suggestion exists within the prior art of such requirements.

As noted previously, the preferred metal salts for this procedure are silver (I) nitrate, nickel (II) perchlorate, copper (II) acetate, and iron (II) sulfate. The concentrations of these salts within the immersion bath can be increased to ~2% before the kinetics of reduction and aggregation overwhelm the kinetics of polymer adsorption and mixing and cause significant aggregation/clumping of the metal. The preferred metal salt is silver (I) nitrate and is present in a concentration of from about 0.001% to about 2.0%, more preferably from about 0.01% to about 1.0%, and most preferably about 0.1% within the immersion bath.

The preferred reducing agents are sodium borohydride ($NaBH_4$), trisodium citrate ($Na_3C_6H_5O_7$), and sodium hydrosulfite, although any standard reducing agent associated with the above-listed metal salts may be utilized. The former is a stronger reducing agent that reacts with the metal completely within seconds of mixing. An undesirable byproduct of this reaction is hydrogen gas that causes significant foaming when mixed. The latter two do not have this effect, but are milder reducing agents and require heating to near boiling to cause the reaction to proceed.

The polymeric binder may be selected from certain resins and thermoplastics, such as melamine resins and polyvinyl chloride-containing polymers. Of particular interest, and thus the preferred polymeric binders for this process are melamine-formaldehyde resins (such as a resin available from BFGoodrich under the tradename Aerotex®) and polyvinyl chloride/vinyl copolymers (such as a copolymer also available from BFGoodrich under the tradename Vycar® 460×49). It has been found that upon exposure to an ammonium sulfate catalyst and curing at 350° F. for 2 minutes, the melamine provides durable finish on either a fiber or a fabric of at least 30 washes. The copolymer requires no catalyst and performs similarly to the melamine in wash durability when cured for the same time and at the same temperature.

The solution described above can be applied to fabric or yarn in a number of ways. Included in this list, which is by no means exhaustive, are pad coating, screen coating, spraying, and kiss-coating (particularly for yarn applications). The preferred coating and method are discussed in greater depth below.

Utilization of ALPHASAN® may also be followed without the need for reducing agents. However, the same nonionic binding agents may be utilized to effectuate the same long-term wash durable antimicrobial fabric treatment.

The preferred embodiments of these fabric treatments are discussed in greater detail below.

DESCRIPTION OF THE PREFERRED EMBODIMENTS

Examples of particularly preferred compounds within the scope of the present invention are set forth below.

Silver-Particle Yarn and Fabric Treatments

The dispersions used in the durability and log kill study for the resultant articles with silver-particle treatments contained the following concentrations (all % are per weight of solution): 1% $AgNO_3$, 0.5% $NaBH_4$, 5% binder resin, 3% hydroxyethylcellulose thickener, and 90.5% water. The print pattern used was a 12 dpi dot pattern with each dot having ~0.5 mm diameter circular shape.

Three sets of samples were tested at three different numbers of washes. The three sets were: a) untreated scoured polyester fabric, b) scoured polyester fabric treated with just the desired binder resin, and c) scoured polyester fabric treated with the above-described silver-particle dispersion. Each sample was tested for 0, 15, and 30 washes. To minimize the potential biocidal activity of the detergent, the 15 and 30 wash samples were run through two additional rinse cycles before analysis. In the pertinent Tables which follow, the log kill results were performed with a) an initial *Staphylococcus aureus* concentration of $3.8\times10^6$ CFU/mL and b) a *Klebsiella pneumoniae* inocculum initial concentration of about 18,000,000 CFU/mL.

The following three treatments were performed and shown to be create a highly washfast metal particle finish:

1) Pad Coating

The fabric article (100% polyester fabric) was dipped into a silver particle/polymeric dispersion comprising about 1 parts of silver colloid and about 5 parts of a binder resin. Particular resins tested were Aerotex® M3, Vycar® 460×49, and a PVC/Acrylic resin (all resins available from BFGoodrich). The immersed fabric was then removed and run through a pad roll. The fabric was then heated to 350° F. for 2 minutes. The resulting fabric was then first analyzed for particle count remaining on the fabric surface after treatment by ICP spectroscopy, both initially and after a number of washes utilizing the standard laundering procedure of AATCC Test Method 130-1981. The results are presented in tabular form below:

TABLE 1

Particle Count on Fabrics Pad Coated with Silver Particle Dispersions

| # of Washes | ICP for Silver (ppm) PVC/Acrylic Binder | ICP for Silver (ppm) Aerotex ® M3 Binder |
|---|---|---|
| 0 | 5210 | 7074 |
| 10 | 3993 | 6250 |
| 20 | 3555 | 6149 |
| 30 | 2841 | 4965 |

Thus, the retention of the metal finish was excellent for both binders (77% after 10 washes, 68% after 20, 55% after 30 for the PVC/Acrylic binder; 88% after 10 washes, 87% after 20, and 70% after 30). It should be noted that these measurements are subject to the variability within the measuring instrument as well; although they are considered relatively and should not deviate in any significant amount from the tabulated results, variations in results may occur. Furthermore, the treated fabrics were also tested for electrical conductivity through the method noted above (AATCC Test Method 76-1978); the noise of the measuring instrument exceeded any signal of the resistance measuring instrument, thus, the resistance is so high for the fabric that no appreciable conductivity was exhibited by all of the tested samples.

2) Yarn Application

In this method, the metal particle dispersion was applied utilizing a kiss-coater, which consists of a roll which constantly rotates in a bath of the metal dispersion. The roll transferred the solution to the top side of the roller, where an end of yarn passed against the roller and into an oven where it was cured at 350° F. for 2 minutes then taken up onto a bobbin for further processing. The metal particle coated yarn was electrically non-conductive and typically included from about 20 to 30% by weight of the metal-particle dispersion. The silver-coated yarn was then knit or woven into a fabric with non-treated yarns at a ratio of 1 treated yarn to every 15 untreated yarns. The treated yarns were visible on only one side of the treated fabric and the resultant fabric exhibited excellent sustained antimicrobial performance. Table 3 shows ICP results for silver as a function of washes for a "sock" knit from 70d treated yarn and 500d untreated yarn.

TABLE 2

Durability of Silver-Particle Coated Yarns Woven into Fabrics

| # of Home Washes | ICP for Silver (ppm) With Aerotex ® M3 Binder |
|---|---|
| 0 | 3798 |
| 10 | 3709 |
| 20 | 3297 |
| 30 | 3286 |

The resistivity was again immeasurable, as above, and thus no appreciable conductivity was present.

3) Screen Printing

In a screen printing application, the dispersion described above was thickened and pressed through a printing screen onto one side of a fabric in a finishing step. The preferred thickening agent for this embodiment is Aqualon® Natrosol 99-250 HHR (in a concentration range of 1–10% by weight of solution) with the preferred concentration being 3% (which provides a desired intrinsic viscosity of from about 100,000 to about 400,000, preferably 200,000, centipoise at standard temperature and pressure). The viscosity of the metal particle/polymer dispersion may also be adjusted with the utilization of sufficient amounts of hydroxyethylcellulose; however, mixtures of HEC and the Aqualon® thickeners may prove sufficient to provide a resultant, preferred viscosity of 200,000 cps. Although preferred thickeners for screen printing have been found, one of ordinary skill in this art would appreciate that any number of acceptable thickeners may be utilized, either alone, or in combination, to provide the desired and/or necessity viscosity level in order to perform such a screen printing procedure. The thickened metal-particle containing dispersion was applied to the target fabric by squeezing it through a patterned rotary screen. The "coated" fabric was then cured at 350° F. for at least 2 minutes to produce a coating that was washfast through at least 30 washes. Table 4 provides this durability data:

TABLE 3

Durability of Screen Printing on Fabric with Silver-Particle Dispersions

| # of Home Washes | ICP for Silver (ppm) PVC/Acrylic Binder |
|---|---|
| 0 | 312 |
| 10 | 266 |

TABLE 3-continued

Durability of Screen Printing on Fabric with Silver-Particle Dispersions

| # of Home Washes | ICP for Silver (ppm) PVC/Acrylic Binder |
|---|---|
| 20 | 135 |
| 30 | 109 |

The resistivity was again immeasurable, as above, and thus no appreciable conductivity was present.

The treated fabric was then analyzed for its ability to provide antimicrobial effectiveness against *Staphylococcus aureus* and *Klebsiella pneumoniae*. The results were as follows:

TABLE 4

*Staphylococcus aureus* Effectiveness

| # Washes | Control | Binder | TABLE 4 Fabric |
|---|---|---|---|
| 0 | 0.35 | 0.83 | 5.56 |
| 15 | 1.00 | 1.06 | 4.08 |
| 30 | 0.07 | 1.20 | 5.54 |

TABLE 5

*Klebsiella pneumoniae* Effectiveness

| # Washes | Control | Binder | TABLE 4 Fabric |
|---|---|---|---|
| 0 | 1.93 | 2.28 | 3.94 |
| 15 | 2.73 | 2.79 | 5.33 |
| 30 | 2.04 | 2.66 | 5.33 |

The durable treatment not only retained its integrity over the target fabric surface, but also continued to provide an effective antimicrobial treatment as well.

There are, of course, many alternative embodiments and modifications of the present invention which are intended to be included within the spirit and scope of the following claims.

I claim:

1. A treated substrate comprising a finish comprising a) solid compounds selected from the group consisting of metal particles, metal salts, metal oxides, and any combinations thereof, and b) at least one binder material, wherein said binder material is selected from the group consisting of melamine-formaldehyde resins, acrylic resins, polyvinyl chloride/vinyl copolymers, and mixtures thereof:

a substrate selected from the group consisting of a yarn, a fabric comprised of individual fibers, and a film, and having at least one surface thereof;

wherein said finish is adhered to at least one portion of said surface of said substrate;

wherein said finish is integrally retained on said at least one portion of said surface of said substrate, after 10 washes as performed in accordance with the wash procedure of AATCC Test Method 130-1981, in an amount of at least 30% of the amount of said finish present on said at least one portion of the surface of said substrate prior to the performance of any wash procedure.

2. The substrate of claim 1 wherein said substrate is an individual yarn.

3. The substrate of claim 1 wherein said substrate is a textile fabric.

4. The substrate of claim 1 wherein said finish comprises silver particles.

5. The substrate of claim 1 wherein said treatment is integrally retained in an amount of at least 30% after 20 washes.

6. The substrate of claim 5 wherein said treatment is integrally retained in an amount of at least 30% after 30 washes.

7. The substrate of claim 5 wherein said substrate is an individual yarn.

8. The substrate of claim 5 wherein said substrate is a textile fabric.

9. The substrate of claim 5 wherein said finish comprises silver particles.

10. The substrate of claim 6 wherein said substrate is an individual yarn.

11. The substrate of claim 6 wherein said substrate is a textile fabric.

12. The substrate of claim 6 wherein said finish comprises silver particles.

13. The substrate of claim 1 wherein said at least one portion of said treated substrate exhibits a log kill rate for *Staphylococcus aureus* of at least 1.5 and a log kill rate for *Klebsiella pneumoniae* of at least 1.5 after 10 washes as performed in accordance with the wash procedure of AATCC Test Method 130-1981.

14. The substrate of claim 5 wherein said at least one portion of said treated substrate exhibits a log kill rate for *Staphylococcus aureus* of at least 1.5 and a log kill rate for *Klebsiella pneumoniae* of at least 1.5 after 10 washes as performed in accordance with the wash procedure of AATCC Test Method 130-1981.

15. The substrate of claim 6 wherein said at least one portion of said treated substrate exhibits a log kill rate for *Staphylococcus aureus* of at least 1.5 and a log kill rate for *Klebsiella pneumoniae* of at least 1.5 after 10 washes as performed in accordance with the wash procedure of AATCC Test Method 130-1981.

* * * * *